US005873148A

United States Patent [19]

Arnold

[11] Patent Number: 5,873,148

[45] Date of Patent: Feb. 23, 1999

[54] ERGONOMIC HANDLE SYSTEM

[75] Inventor: Robert L. Arnold, Jacobus, Pa.

[73] Assignee: Hand Tool Design Corporation, Wilmington, Del.

[21] Appl. No.: 784,196

[22] Filed: Jan. 15, 1997

[51] Int. Cl.[6] ..... B25G 1/00

[52] U.S. Cl. ..... 16/111 R; 16/114; 16/DIG. 12; 81/177.1

[58] Field of Search ..... 16/114 R, 111 R, 16/DIG. 12, DIG. 18, DIG. 19; 81/177.1, 489; 482/47

[56] References Cited

U.S. PATENT DOCUMENTS

| | | | |
|---|---|---|---|
| 2,091,458 | 8/1937 | Sleight | 273/72 |
| 2,235,792 | 3/1941 | Bauman | 16/116 R |
| 3,981,043 | 9/1976 | Curry | 16/110 R |
| 4,617,697 | 10/1986 | David | 16/110 R |
| 4,785,495 | 11/1988 | Dellis | 16/111 R |

*Primary Examiner*—Chuck Mah
*Assistant Examiner*—Donald M. Gurley
*Attorney, Agent, or Firm*—Leonard Bloom

[57] ABSTRACT

A handle system for a tool to fit the fingers of a hand of a user. At least two individual segments disposed adjacent to one another along a center sleeve. Projections and cooperating counterbores are formed on the edges of the respective segments such that the segments nest on the handle. The segments are axially slidable with respect to one another to accommodate the fingers of the hand. The segments may have grooves to receive the respective fingers. In a possible alternate embodiment, a center ridge is formed on each segment to be received between the fingers of the user's hand. In a system alternate embodiment, a removable handle system for a tool has individual axially slidable keyed or unkeyed segments on a center member. The center member engages the handle of the tool.

20 Claims, 10 Drawing Sheets

ERGONOMIC HANDLE SYSTEM

BACKGROUND OF THE INVENTION

The present invention relates to a handle system for tools and in particular, to individual segments which cover the tool handle and which are contoured, and can move to fit the hand of the user.

Tool handles are configured in many designs intended to facilitate use of the tool by the user. Most handles are configured to be comfortable for the user and many have contours to accommodate the separate fingers of the user's hand.

U.S. Pat. No. 2,091,458 to Sleight discloses an adjustable handgrip which has either separate finger numbers or a tube with finger stalls provided with teeth to improve the grip. The finger members have an inner surface provided with suction cups to hold the members on the handle.

U.S. Pat. No. 3,981,043 to Curry discloses a slidable hand grip for a tool which normally requires the use of two hands. The gripping portion is relatively rigid and is disposed between compressible end pieces.

U.S. Pat. No. 4,617,697 to David discloses a handle adapter constructed in a manner enabling the user to shape the external surface to conform to the grip of the user's hand. The adapter is a pouch with flexible walls which is folded in two and disposed over the handle. U.S. Pat. No. 4,785,495 to Dellis discloses hand grips which are placed on the handle, heated and fitted to the user's fingers. The grip retains the configuration when cooled.

There is a need for a handle for a tool which will accommodate the fingers of any user, irrespective of the size or configuration of the user's fingers and hand. The handle must be self-adjusting to enable use by users with large, medium or small hands. A need further exists for a self-adjusting, universally sized handle system which can be fitted on standard tool handles.

BRIEF SUMMARY OF THE INVENTION

It is an object of the present invention to provide a handle system for a tool utilizing ergonomic principles, whereby, the handle can accommodate hands and fingers of varying sizes during the application of force by the tool user.

It is a further object of the present invention to provide an handle system which is removable and can be placed on and removed from the tool.

In accordance with the teachings of the present invention, there is disclosed a handle system with ergonomic features for a tool to be gripped in the fingers of the hand of a user. The handle has a center sleeve having a length. At least two individual segments are disposed adjacent to one another along the length of the center sleeve. The segments slide axially with respect to one another, being self adjusting to accommodate the fingers of the user.

The segments can be, if desired, longitudinally keyed to the sleeve to prevent rotation of the segments around the sleeve. Alternately, the segments can be keyed to each other and rotate on the handle. Each segment may have a groove formed therein to receive the respective finger of the user.

In another embodiment, there is disclosed a removable handle system for a handle of a tool, the handle fitting the fingers and hand of a user. The handle includes a center member which has a length. An opening is formed in the center member extending approximately the length of the center member. At least two individual segments are disposed adjacent to one another along the length of the center member, each segment circumscribing the center member. The segments slide axially, with respect to one another, being self-adjusting, to accommodate the fingers of the user. The center member has means thereon to releasably engage the handle of the tool in the opening in the center member such that the handle system may be disposed on, or removed from, the handle of the tool.

These and other objects of the present invention will become apparent from a reading of the following specification taken in conjunction with the enclosed drawings.

DESCRIPTION

Figure 1:
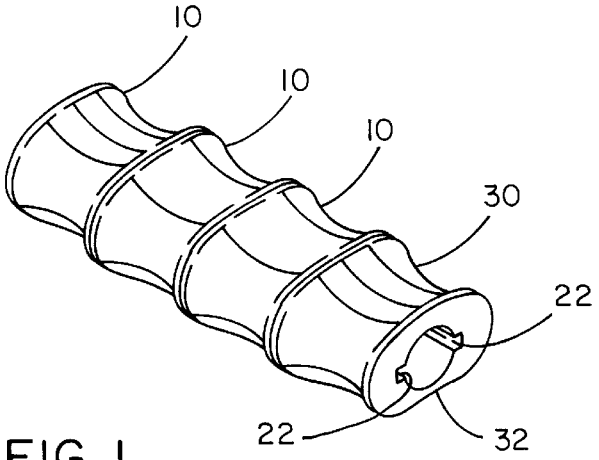
FIG. 1 is a perspective view of one side of the segments of one embodiment of the present invention.
Figure 2:
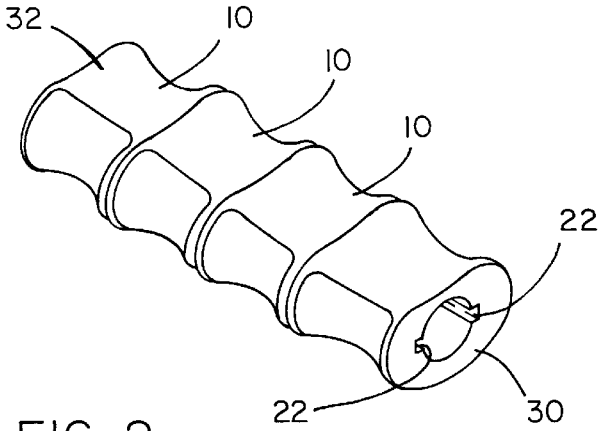
FIG. 2 is a perspective view of the opposite side of the segments of the one embodiment of the present invention.

Referring to FIGS. 1–9, a handle system has at least two, and preferably four or five, segments 10 disposed adjacent to one another along a length of a center sleeve 12. Each segment 10 may encircle the sleeve. Each segment 10 has a first edge 14 and an opposite second edge 16. The respective edges of the adjacent segments 10 are facing one another. Preferably, each edge 14, 16 has a respective projection 18 or counterbore 20 although a projection and counterbore are not essential. The projection 18 on the edge 14, 16 of one segment 10 cooperates with the counterbore 20 in the edge 14, 16 of the adjoining segment 10. The end segments do not necessarily have either a projection or a counterbore on the edge which is distal from the other segments. The configuration of adjacent projections 18 and counterbores 20 permits the plurality of segments 10 to nest together. Separation of the segments 10 over a distance not greater than the width of the respective projections 18, maintains a cover over the center sleeve 12. In this manner, the segments 10 may be slid axially with respect to one another to accommodate the fingers of the user while the center sleeve 12 is covered over approximately the length of the center sleeve 12. End caps or means to secure the outermost segments 10 to the center sleeve 12 limit the extent of sliding movement of the segments 10 between the outermost (or first) segments.

Figure 6:
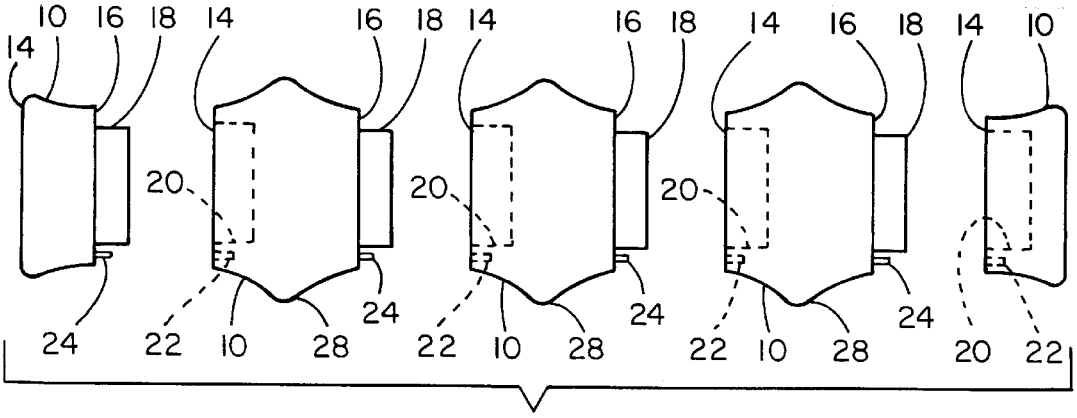
FIG. 6 is a top plan view of the segments of another embodiment of the present invention.

If desired, a longitudinal key means is formed between the segments 10 and the center sleeve 12. The key means may be one or more keyways 22 formed on the inner surface of each segment 10 and a corresponding key 24 formed along the length of the center sleeve 12. Alternately, the keys 24 may be formed on the inner surface of each segment 10 and one or more keyways 22 formed along the length of the center sleeve 12. In this manner, the segments 10 are prevented from rotating around the center sleeve 12. In a further embodiment, each segment 10 may be keyed to the adjoining segment 10 to limit rotation with respect to each other (FIG. 6).

Figure 3:
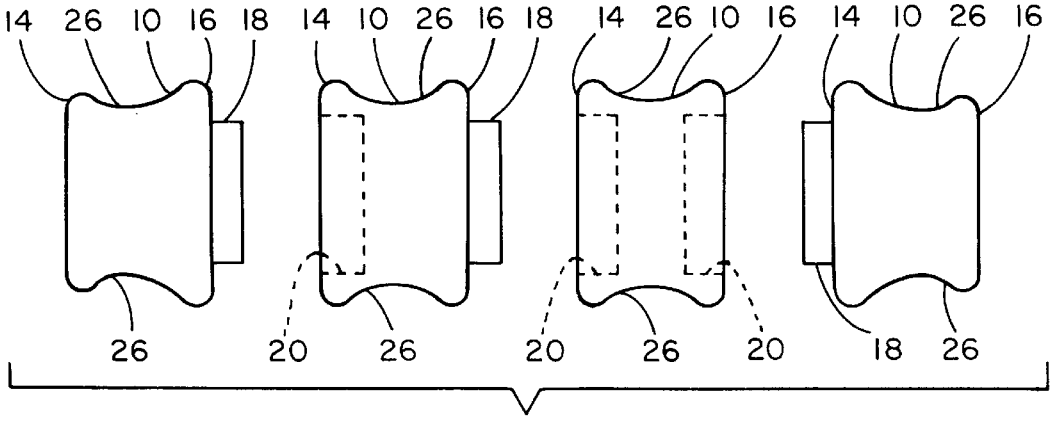
FIG. 3 is a top plan view of the segments of FIG. 1.
Figure 7:
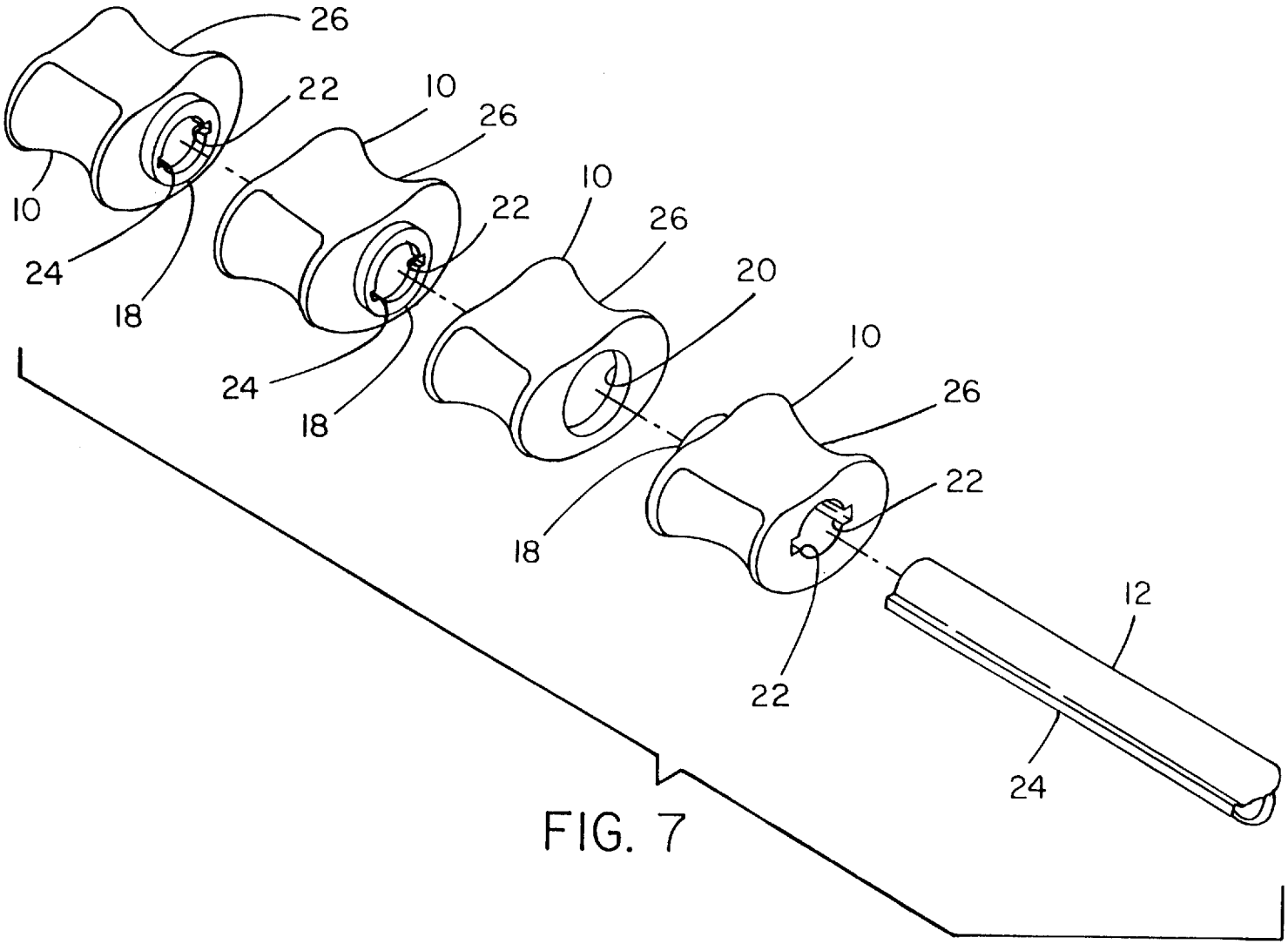
FIG. 7 is an exploded perspective view of the segments of the one embodiment removed from the center sleeve.

In the preferred one embodiment, the outer surface of each segment 10 has a groove 26 formed therein to receive the respective finger of the user's hand. Preferably, the groove 26 is centrally disposed between the edges 14, 16 of the segment 10. The surfaces adjoining the respective edges 14, 16 are thereby elevated with respect to the groove 26 (FIG. 2) and the elevated surface of adjacent segments 10 are disposed between the fingers of the user's hand (FIG. 7). It is preferred that four segments 10 be located adjacent to one another to accommodate the four fingers of the user's hand. Preferably, all of the ridges 1L4, 16 are of the same size except the first edge 14' and second edge 16' of the respective end segments 10 are approximately ¼ inch smaller in total height (FIG. 3).

In an alternate embodiment, a center ridge 28 is formed in each segment 10. The surfaces of the respective segment 10 on either side of the ridge 28, and adjoining the respective edges 14, 16, are depressed with respect to the center ridge 28 (FIG. 6). The fingers of the user's hand are disposed over the depressed surfaces on adjacent segments 10 and the center ridges 28 are disposed between the fingers of the user's hand. It is preferred that three segments 10 be located adjacent to one another to accommodate the spacing between the four fingers of the user's hand and in addition, a pair of end segments be provided to be fitted to the little finger and index finger of the user's hand.

The segments 10 of either embodiment preferably are disposed on a center sleeve, however, the segments 10 may be slid directly over the handle of a tool, where the handle serves as the center sleeve.

Figure 4:
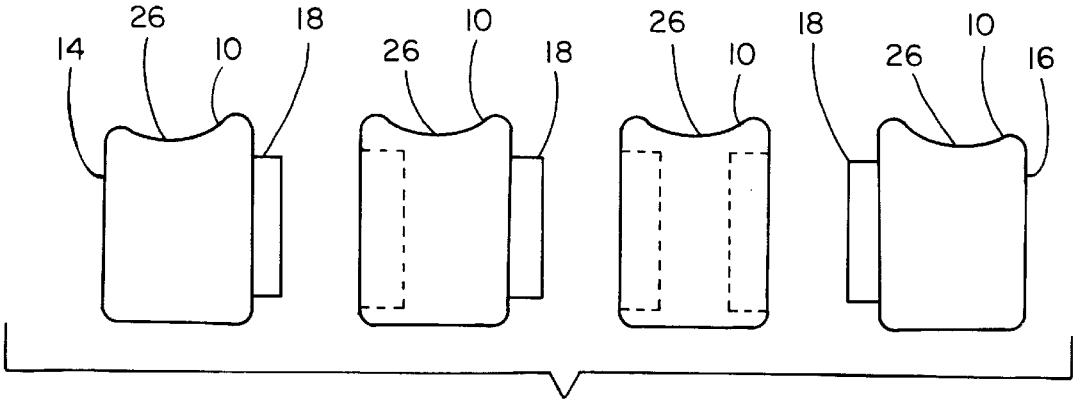
FIG. 4 is a side elevation view of the segments.
Figure 5:
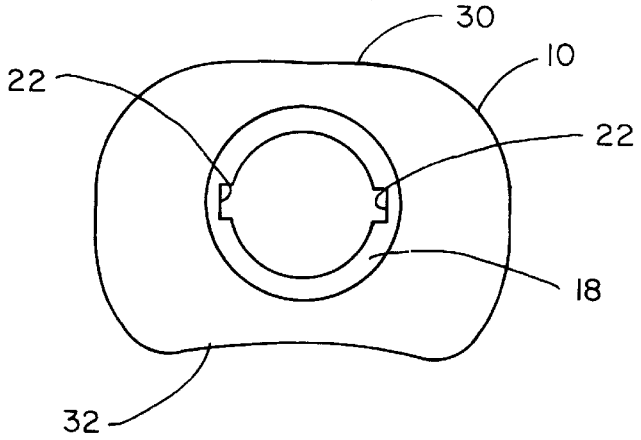
FIG. 5 is an end view of a segment of FIG. 1.
Figure 8:
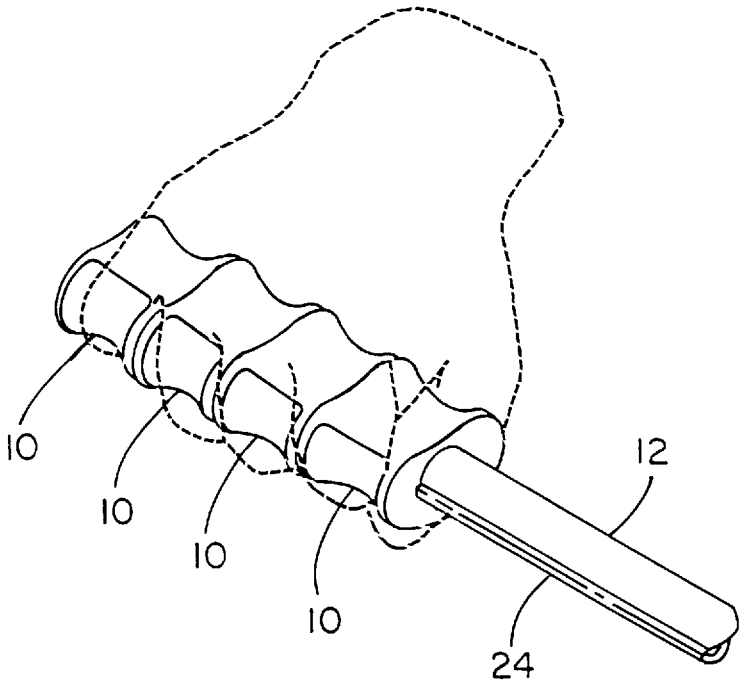
FIG. 8 is a perspective view of the segments of FIG. 7 disposed on the center sleeve and showing the user's hand in hidden lines.
Figure 9:
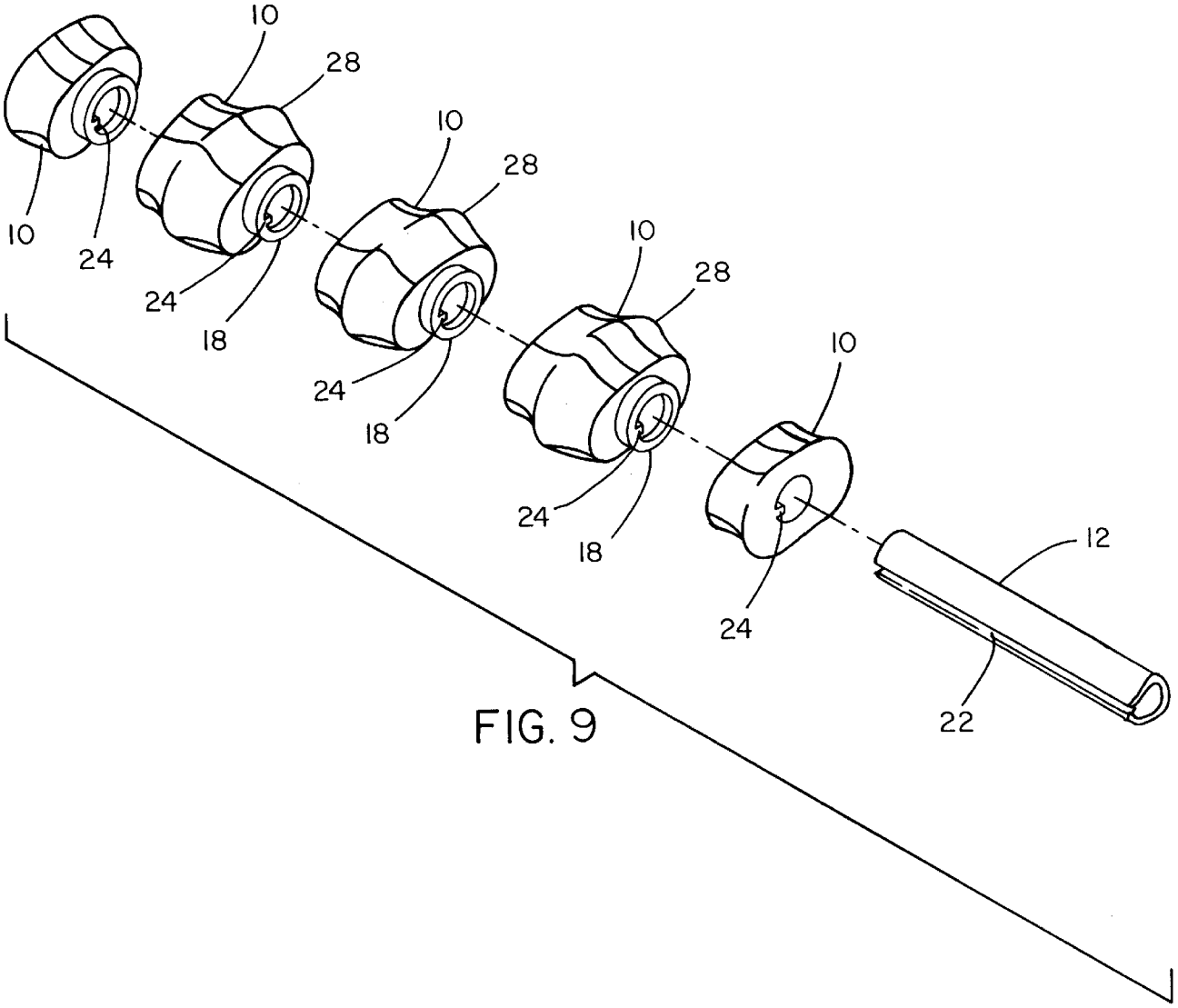
FIG. 9 is an exploded perspective view of the segments of another embodiment removed from the center sleeve and showing keys on the segments and a keyway on the center sleeve.

In order to provide an improved ergonomic configuration, it is preferred that the first side 30 of each segment 10 is contoured as described above with the groove 26 or the center ridge 28. The opposite, second side 32 of each segment 10 is slightly concave to accommodate the inside of the user's hand at the base of the fingers when the handle is gripped by the user (FIGS. 4, 5 and 8). The slight concavity provides a more comfortable, less stressful grip. Alternately, the second side 32 may be approximately flat (planar).

Figure 10:
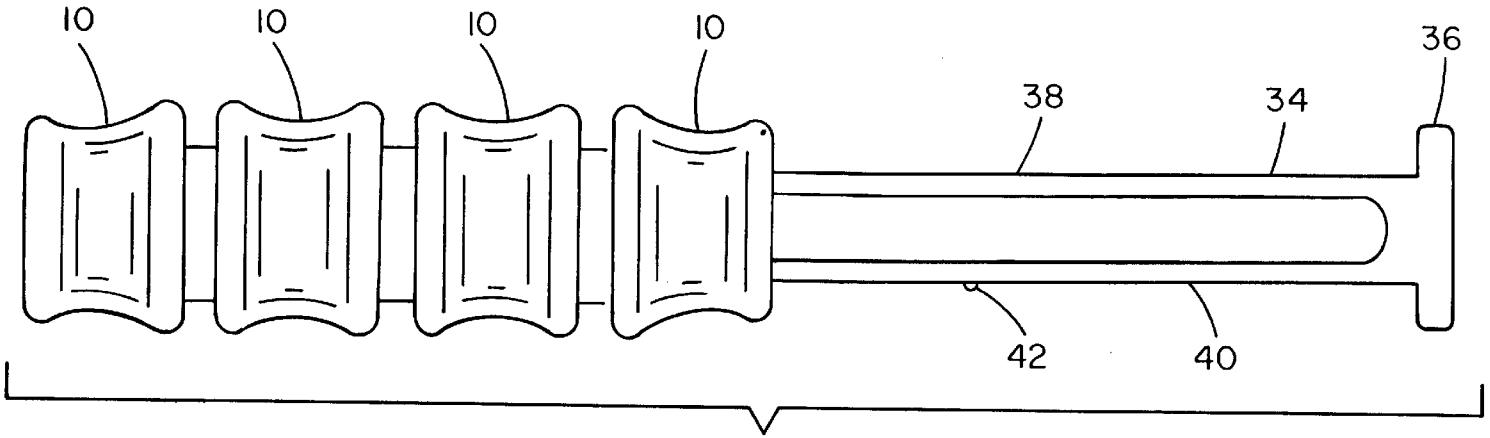
FIG. 10 is a top plan view showing the segments of the one embodiment to be received on a center member to form a removable handle.
Figure 11:
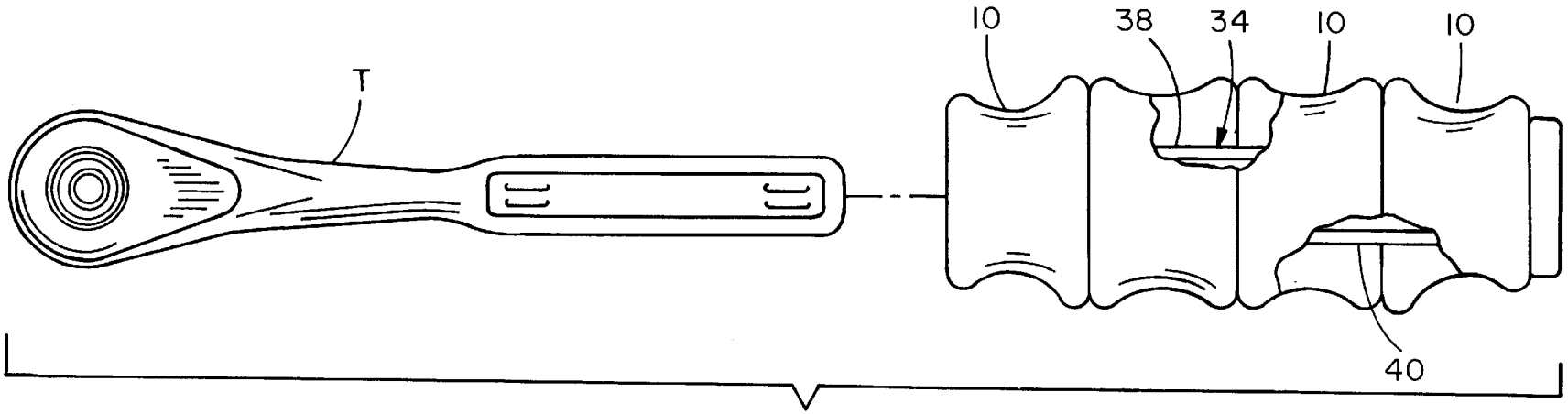
FIG. 11 is a top plan view showing a removable handle with the segments of the one embodiment to be placed on the handle of a tool.
Figure 12:
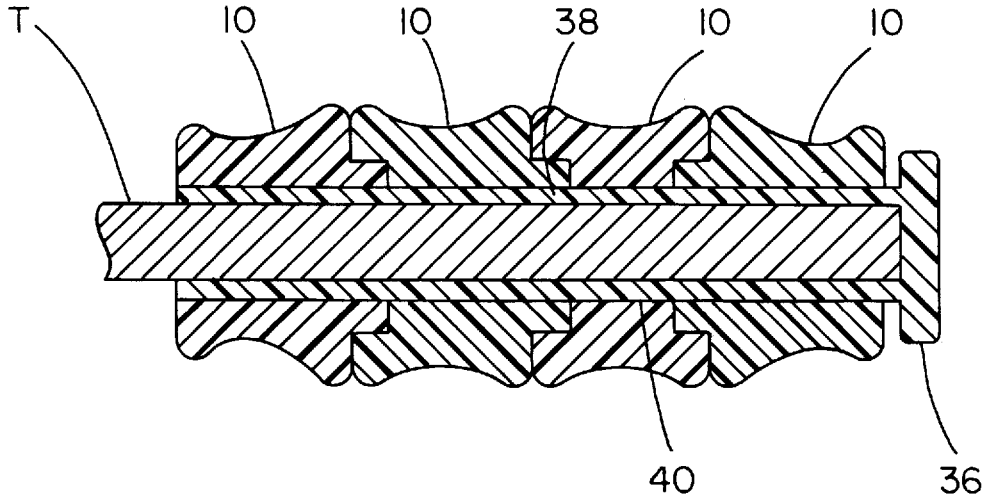
FIG. 12 is a cross-section view of the removable handle with the segments of another embodiment on the handle of the tool.
Figure 13:
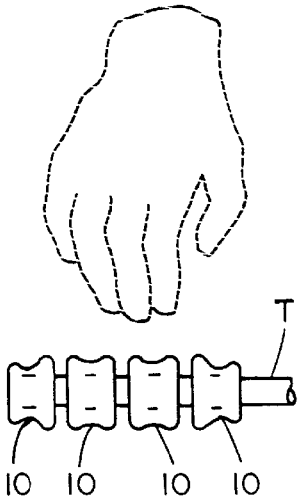
FIGS. 13–15 are a sequence showing the gripping of the handle of the present invention by a user having a large hand.
Figure 14:
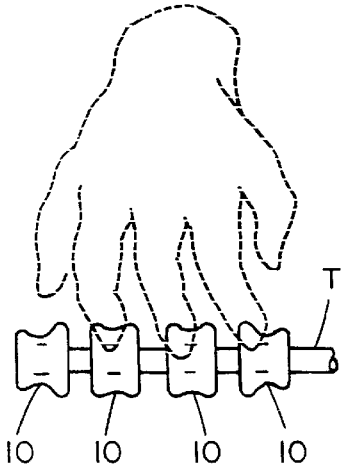
Figure 15:
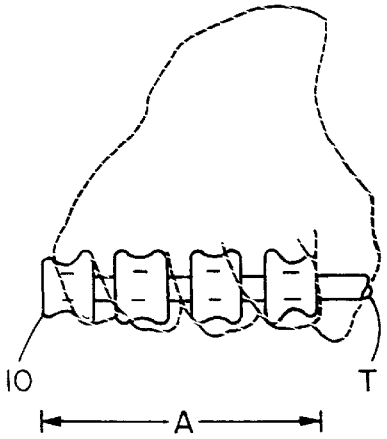
Figure 16:
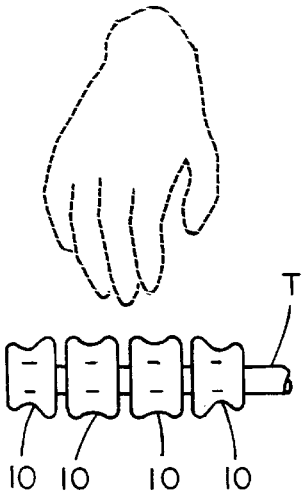
FIGS. 16–18 are the sequence of FIGS. 13–15 showing a user having a small hand gripping the handle of the present invention.
Figure 17:
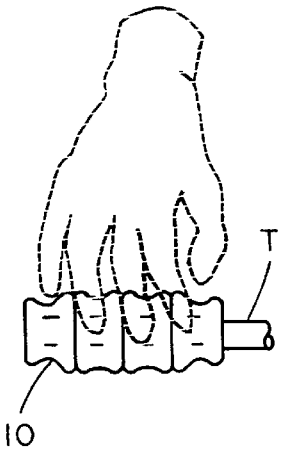
Figure 18:
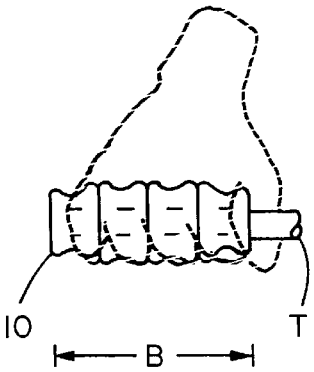

In an alternate embodiment, the handle system is removable to permit placement on, and removal from, the handle of a tool T (FIGS. 10–12). A center member 34 has a length and an opening formed lengthwise in the center member 34. At least two, and preferably four or five individual segments 10, are adjacent to one another and having protrusions 78 and counterbores 20 to permit nesting of the segments 10 and covering of the center member 34. The segments 10 are axially slidable with respect to one another and are contoured to fit the fingers of the user's hand. The sliding ability provides a self-adjusting capability to the segments 10 such that the fingers move each segment 10 sufficiently to adjust the adjacent segments to the most comfortable and best fitting location for the individual fingers.

The center member 34 has an end cap 36 such that the end segment 10 (the segment contacting the end cap) is retained on the center member 34 and serves as a stop for the remainder of the segments 10.

The center member 34 is provided with means to engage the tool T in the opening in the center member 34. The engagement is possible through various means. In one embodiment, the center members has two sides 38 and 40, one side being opposite the other. The sides 38, 40 extend the length of the center member 34 and are joined at the end cap 36. The sides 38, 40 are spaced apart forming the opening therebetween. The sides 38, 40 are resiliently biased with respect to one another such that the sides 38, 40 are urged against the handle of the tool T such that the handle system is removably retained on the tool T.

Alternately, the center member 34 has at least one detent means 42 formed on the inner surface thereof, confronting the opening in the center member 34. The at least one detent means 42 removably retains the handle system on the handle of the tool T (FIG. 10).

In another embodiment, the opening in the center member 34 has a cross section which is a friction fit with the handle of the tool 10 to removably retain the handle system on the handle of the tool T.

The inner cross section of the center member 34 may be round, oval, or any other shape to permit the handle of the tool T to be inserted in the opening in the handle system and to retain the handle system on the tool.

The embodiment of a removable handle system preferably incorporates the features previously described, i.e., the segments 10 keyed to the center member 34, the segments 10 contoured with either grooves 26 or ridges 28 and the first side 30 contoured and the opposite second side 32 being slightly concave.

As shown in FIGS. 13–18 the user grips the handle system with the user's fingers accommodated by the contour of the segments 10. As the user's hand contacts the respective segments 10, the segments 10 move apart or together depending upon the size of the user's hand. With a user having a large hand (FIGS. 13–15) the segments 10 extend over a space A when the user holds the handle system. With a user having a small hand (FIGS. 16–18) the segments extend over a space B when the user holds the handle system. Space A is greater than space B.

Figure 19:
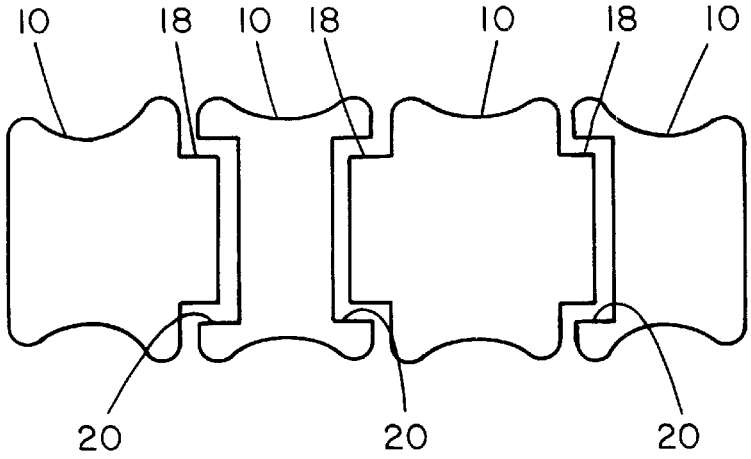
FIG. 19 is schematic top plan view showing all of the segments being different.
Figure 20:
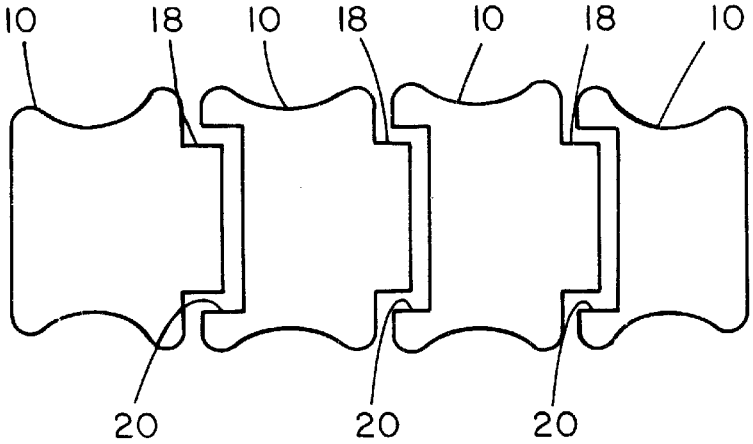
FIG. 20 is a schematic top plan view showing two center segments being identical and two end segments being different.
Figure 21:
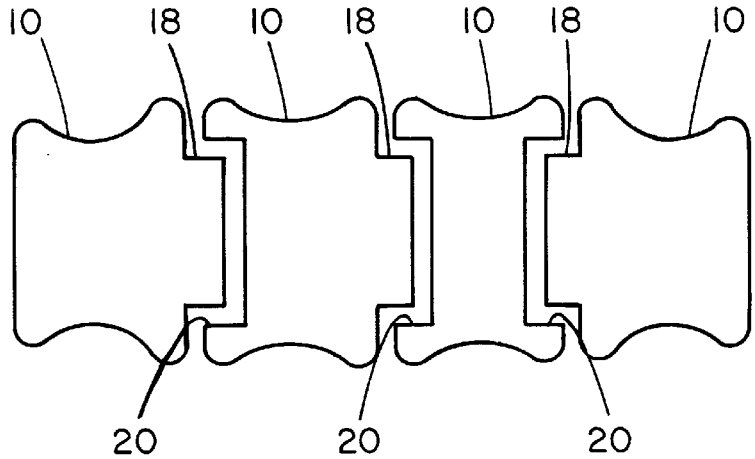
FIG. 21 is a schematic top plan view showing two end segments having identical projections and two center segments being different.
Figure 22:
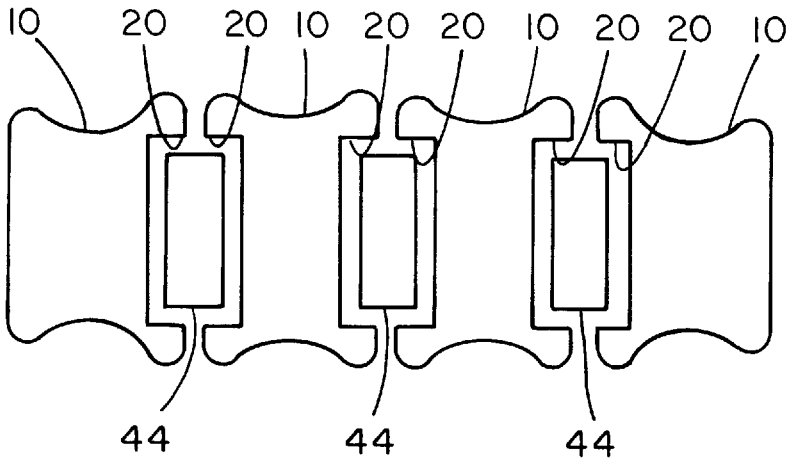
FIG. 22 is a schematic top plan view showing two end segments having identical counterbores and two center segments being different.
Figure 23:
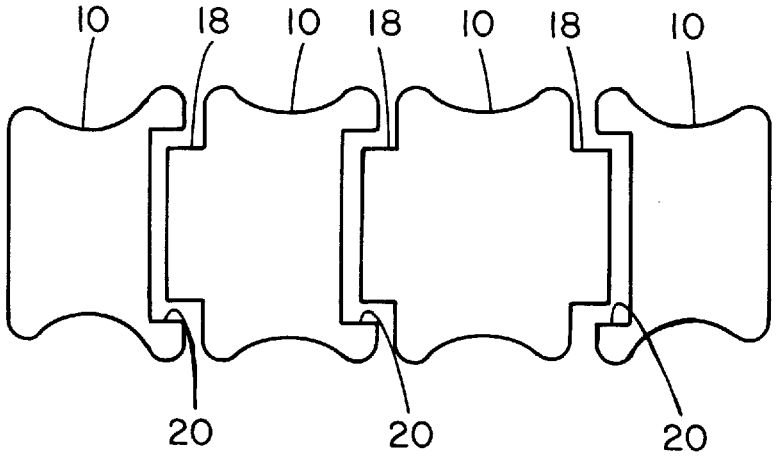
FIG. 23 is a schematic top plan view showing all segments having counterbores and inserts received in the counterbores between each segment.

In order to have the segments 10 with the respective projections and counterbores substantially covering the center sleeve 12 (or center member 34), there are several types of segments 10 which can be arranged. Shown in FIGS. 19–23 are segments 10 having a groove 26 formed therein. FIG. 19 shows four different types of segments with respect to the projections and counterbores. FIG. 20 shows two inner segments 10 identical and the two different outer segments 10, one having a projection and the other having a counterbore. FIGS. 21 and 23 show two different inner segments and two identical outer segments. The outer segments in FIG. 21 both have projections whereas the outer segments in FIG. 23 both have counterbores. FIG. 22 shows all of the segments having counterbores with separate insert connectors 44 between each adjacent segment. The respective insert connectors 44 are double-sided projections which cooperate with the respective counterbores.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A handle system with ergonomic features for a tool to be gripped by the fingers of a hand of a user, the handle comprising:

a center sleeve having a length, at least two individual segments each having an axial opening for recieving the center sleeve and, disposed adjacent to one another along the length of the center sleeve, and each segment slidable axially along the center sleeve with respect to one another, being self adjusting to accommodate the fingers of the user's hand.

2. The handle system of claim 1, further comprising each segment having a first edge and a second opposite edge, the edges having respective projections and counterbores, wherein the segments nest with each other and the sleeve is covered.

3. The handle system of claim 1, wherein the segments are keyed to the center sleeve to prevent rotation of the segments about the sleeve.

4. The handle system of claim 1, wherein the segments are keyed to one another and are rotatable about the sleeve.

5. The handle system of claim 1, wherein each segment encircles the sleeve.

6. The handle system of claim 1, further comprising each segment having a groove formed therein to receive the respective finger of the user.

7. The handle system of claim 6, wherein four individual segments are disposed adjacent to one another along the length of the center sleeve.

8. The handle system of claim 1, wherein a first segment is secured at an end of the sleeve, the remaining segments thereby being retained on the sleeve and being axially slidable with respect to the first segment.

9. The handle system of claim 1, wherein each segment has a first side and an opposite second side, the first side having contours formed therein in which the user's fingers are disposed, the second side being slightly concave to accommodate the inside of the user's hand at the base of the fingers.

10. A removable handle system with ergonomic features for a handle of a tool, the handle system fitting the fingers of a user and comprising:

a center member having a length, an opening formed in the center member extending approximately the length of the center member, at least two individual segments disposed adjacent to one another along the length of the center member, each segment circumscribing the center member, wherein the segments slide axially with respect to one another, being self-adjusting, to accommodate the fingers of the user, and the center member having means thereon to releasably engage the handle of the tool in the opening in the center member such that the handle system may be disposed on, or removed from, the handle of the tool.

11. The handle system of claim 10, wherein the center member comprises a first side and an opposite second side, the sides extending the length of the center member, the sides being resiliently biased such that the sides are urged against the handle of the tool and retain the handle system on the handle of the tool.

12. The handle system of claim 10, wherein detent means are formed on the center member, the detent means retaining the handle system on the handle of the tool.

13. The handle system of claim 10, wherein the center member is frictionally fitted to the handle of the tool, thereby retaining the handle system on the handle of the tool.

14. The handle system of claim 10, wherein the center member has an end cap, an end segment being disposed adjacent to the end cap, the end cap holding an end segment on the handle system.

15. The handle system of claim 10, wherein the segments are keyed to prevent rotation of the segments about the center member.

16. The handle system of claim 10, wherein the segments are keyed to one another and are rotatable about the sleeve.

17. The handle system of claim 10, wherein each segment has a first side and an opposite second side, the first side having contours formed therein in which the user's fingers are disposed, the second side being slightly concave to accommodate the inside of the user's hand at the base of the fingers.

18. The handle system of claim 10, further comprising each segment having a groove formed therein to receive the respective finger of the user.

19. The handle system of claim 18, wherein four individual segments are disposed adjacent to one another along the length of the center member.

20. The handle system of claim 10, further comprising each segment having a first edge and a second opposite edge, the edges having respective projections and counterbores, wherein the segments nest with each other and the sleeve is covered.

* * * * *